US005131070A

United States Patent [19]

Chiu et al.

[11] Patent Number: 5,131,070

[45] Date of Patent: * Jul. 14, 1992

[54] PORTABLE HUMIDIFIER

[75] Inventors: Bernard Chiu, Ashland, Mass.; Timothy Chen, West Covina, Calif.

[73] Assignee: Duracraft Corporation, Sudbury, Mass.

[ * ] Notice: The portion of the term of this patent subsequent to Nov. 19, 2008 has been disclaimed.

[21] Appl. No.: 751,086

[22] Filed: Aug. 28, 1991

Related U.S. Application Data

[63] Continuation-in-part of Ser. No. 509,886, Apr. 17, 1990, abandoned.

[51] Int. Cl.[5] ..... F24F 3/14; H05B 3/78

[52] U.S. Cl. ..... 392/405; 392/403; 392/406; 200/81.9 M; 200/81.9 R

[58] Field of Search ..... 392/405, 405, 407, 394, 392/401, 403, 271, 272, 273, 275; 200/48 C, 81.9 R, 81.9 M

[56] References Cited

U.S. PATENT DOCUMENTS

| | | | |
|---|---|---|---|
| 2,810,167 | 10/1957 | Parks | 392/405 |
| 3,085,145 | 4/1963 | Wray, Jr. | 392/405 |
| 3,723,707 | 3/1973 | Wunderlin | 392/406 |
| 3,892,945 | 7/1975 | Lerner | 392/405 |
| 4,564,746 | 1/1986 | Morton et al. | 219/276 |
| 4,752,423 | 6/1988 | Wong | 392/406 |
| 4,810,854 | 3/1989 | Jursich et al. | 392/406 |
| 5,014,338 | 5/1991 | Glucksman | 392/405 |
| 5,067,169 | 11/1991 | Chiu | 392/406 |

*Primary Examiner*—Bruce A. Reynolds
*Assistant Examiner*—Tuan Vinh To
*Attorney, Agent, or Firm*—John E. Toupal; Harold G. Jarcho

[57] ABSTRACT

A humidifier including a base defining a cavity; a liquid supply tank removably mounted on the base and adapted to maintain a given level of liquid in the cavity; an electrically energized humidification unit for inducing dispersal of the liquid contained in the cavity; an electrical supply for supplying electrical energy to the humidification unit; and a sensing circuit for preventing electrical energization of the humidification unit with the tank removed from the base.

10 Claims, 3 Drawing Sheets

PORTABLE HUMIDIFIER

CROSS-REFERENCE TO RELATED APPLICATION

This application is a continuation-in-part of U.S. patent application Ser. No. 07/509,886, entitled "Portable Humidifier", filed Apr. 17, 1990, now abandoned.

BACKGROUND OF THE INVENTION

This invention relates generally to humidifiers and, more specifically, to portable humidifiers intended for domestic use.

Various types of products are used to increase the humidity in the home environment. With respect to portable humidifying appliances, they may be broken down broadly into two categories, one being the evaporation type and the other being the steam vaporizer type. Evaporation type humidifiers typically utilize belts, pumps, slingers or the like to increase the rate of evaporation of the water from the liquid to the vapor state. Steam vaporizers generally are used to achieve very high humidification levels. Also known are humidifiers which use ultrasonic means to atomize water and thereby increase humidity.

Examples of various prior art steam vaporizers are disclosed in U.S. Pat. Nos. 2,369,623; 2,804,870; 2,810,167; 3,152,240; 3,723,707; 4,604,246 and 4,810,854. All of these patents are characterized by disclosing steam type humidification means in which there is a reservoir or water supply of some type which supplies water in controlled amounts to a boiler or heating means which is intended to convert the water into a steam vapor.

There are many problems involved with the prior art steam vaporizers. For example, the mineral deposits left by boiled water is difficult to clean and often causes deterioration of heater elements. Also, unsafe operation can exist under certain conditions such as operation without an adequate water supply.

The object of this invention, therefore, is to provide an improved humidifier with an evaporator easily reached for cleaning and a means for insuring the existence of an adequate water supply.

SUMMARY OF THE INVENTION

The invention is a humidifier including a base defining a cavity; a liquid tank removably mounted on the base and adapted to maintain a given level of liquid in the cavity; an electrically energized humidification mechanism for inducing dispersal of the liquid contained in the cavity; and an electrical supply for supplying electrical energy to the humidification mechanism. Also included is a sensing means adapted to deactivate the electrical supply in response to removal of the tank from the base. The sensing means prevents operation of the humidifier with the tank removed.

According to one feature of the invention, the sensing means comprises a control circuit including an electrical switch adapted in an active state to allow energizing current flow to the humidification mechanism and in an inactive state to prevent current flow thereto. The switch is arranged to be in its active state with the tank on the base and in its inactive state with the tank removed from the base.

According to another feature of the invention, the electrical switch is a magnetically operated switch mounted on the base and operatively coupled to the supply, and a magnet mounted on the tank and arranged to activate the switch into its active state with the tank mounted on the base and to deactivate the switch means into its deactive state with the tank removed from the base. The magnetic switch promotes safe operation by preventing energization of the humidification mechanism with the tank removed from the base.

According to still other features of the invention, the evaporator is removable from the base and is enclosed by a latticed enclosure. The enclosure restricts physical access to the evaporator for safety but facilitates settling of sediment to the bottom of the cavity to facilitate cleaning.

DESCRIPTION OF THE DRAWINGS

These and other objects ad features of the invention will become more apparent upon a perusal of the following description taken in conjunction with the accompanying drawings wherein.

DESCRIPTION OF THE PREFERRED EMBODIMENT

Figure 1:
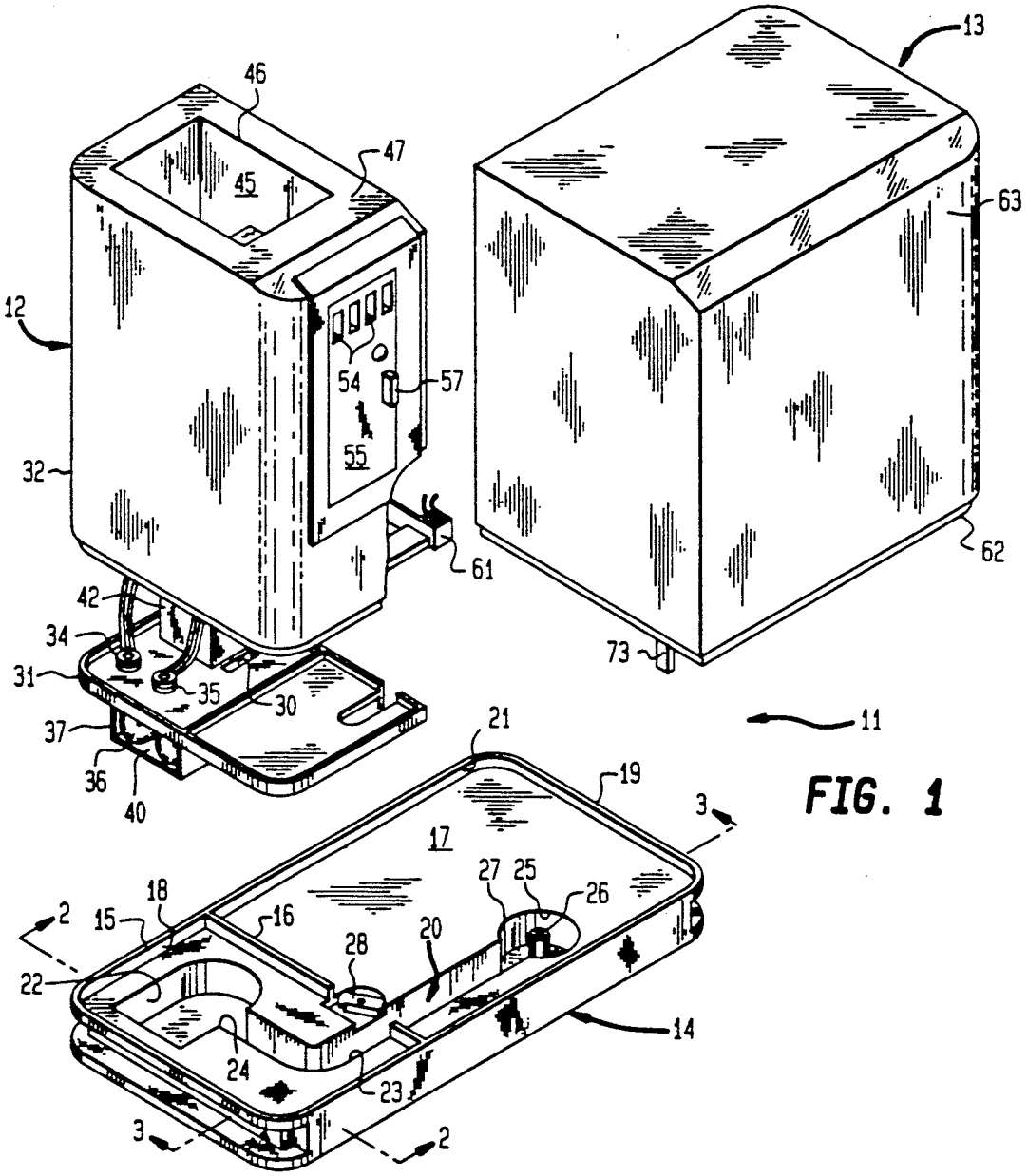
FIG. 1 is an exploded perspective view of a humidifier.

A humidifier 11 includes an evaporation unit 12 and a liquid supply tank 13 each removably mounted side by side on a base 14. A peripheral rim portion 15 and a divider wall 16 project upwardly from an upper surface 17 of the base 14 and define an evaporator enclosure 18 for removably receiving the evaporation unit 12. Similarly a peripheral portion 19 projecting upwardly from the upper surface 17 and the divider wall 16 define a tank enclosure 21 for removably receiving the supply tank 13.

Formed in the base 14 and below the base surface 17 is a reservoir 20 that includes a boiler cavity 22 disposed within the enclosure 18. Also included in the reservoir 20 is a liquid supply channel 23 having an outlet end 24 communicating with the boiler cavity 22 and an inlet end 25 located within the tank enclosure 21. A valve actuator stem 26 projects upwardly from a bottom 27 of the liquid supply channel 23 into the inlet end 25. Pivotally mounted on the base surface 17 is a latch member 28 for securing the unit 12 to the base 14.

Figure 2:
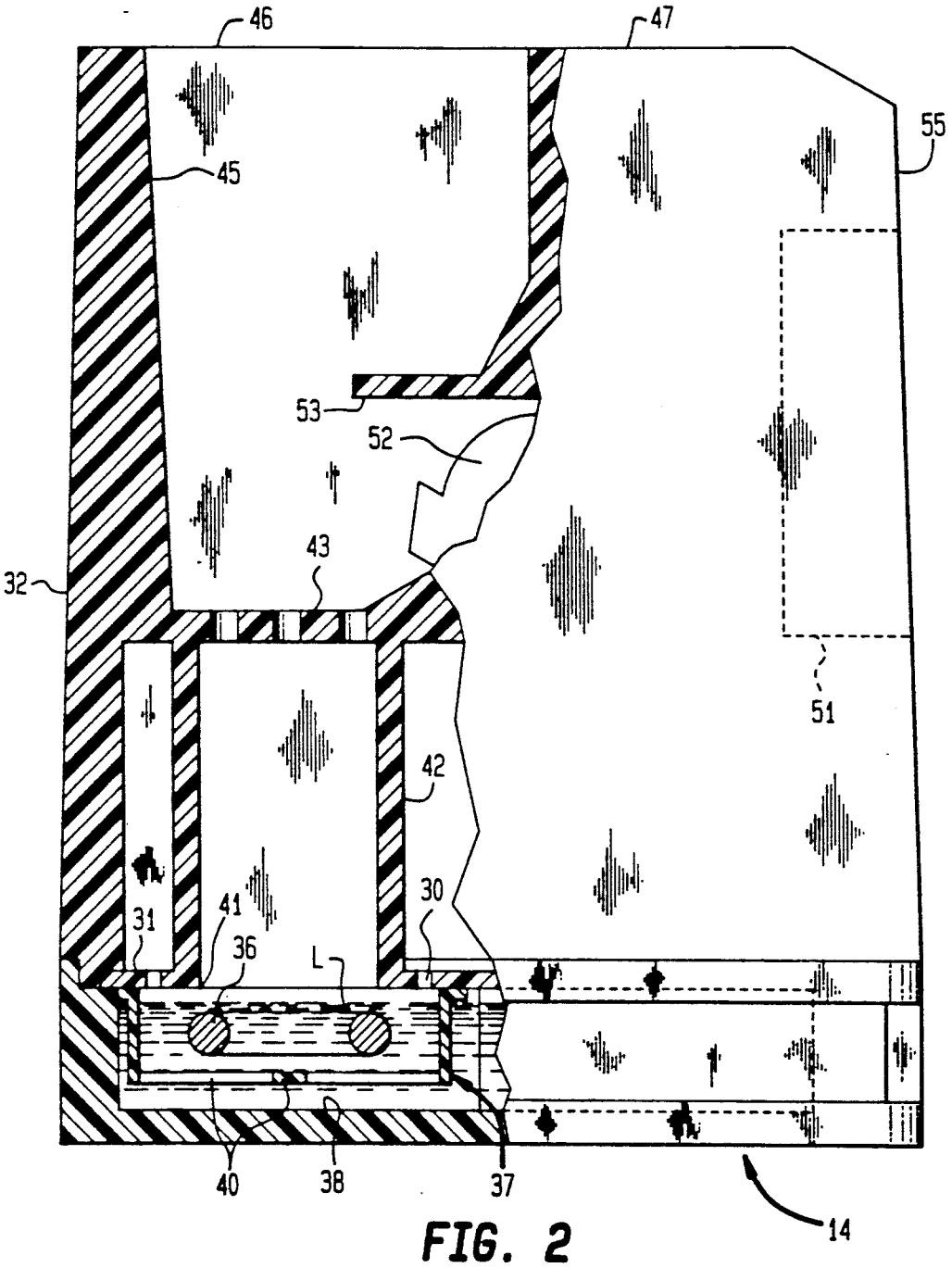
FIG. 2 is a view taken along lines 2—2 of FIG. 1.
Figure 5:
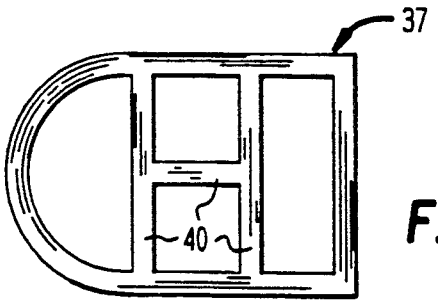
FIG. 5 is a bottom view of an enclosure shown in FIG. 2.

The evaporation unit 12, as shown in FIGS. 1 and 2, includes a bottom plate 31 and an enclosure 32 supported thereby. Supported by electrical terminals 34, 35 on the bottom plate 31 and extending downwardly therefrom is a humidification producing heater coil 36 that projects into the boiler cavity 22 in the base 14. An enclosure 37 secured to the bottom plate 31 encloses the heater coil 36 so as to prevent physical access thereto upon removal of the unit 12 from the base 14. As shown in FIG. 5 a latticed bottom wall of the enclosure 37 is formed by struts 40 so as to provide communication with the cavity 22. Because of the latticed bottom wall 40, solid sedimentary particles created during evaporation can fall substantially unimpeded in a vertical direction to the bottom 38 of the cavity 22. Such sediment is easily cleaned from the bottom 38 after removal of the unit 12 from the base 13.

Figure 3:
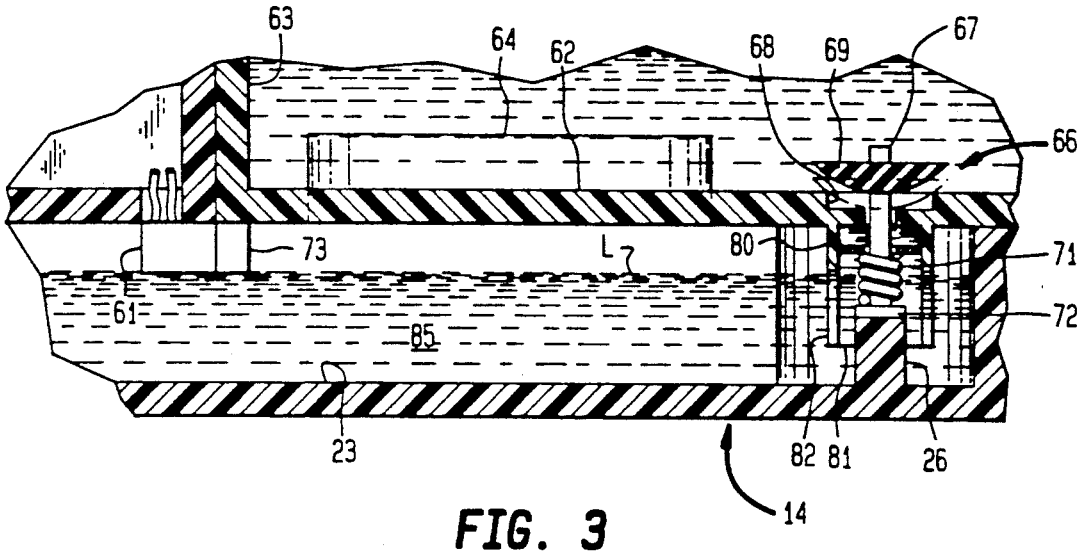
FIG. 3 is a view taken along lines 3—3 of FIG. 1.

Extending upwardly from the bottom plate 31 over an opening 41 communicating with the enclosure 37 in the cavity 22 is a rectangular tube 42. A slotted cover 43 closes the upper end of the tube 42. The slotted cover 43 provides fluid communication between the tube 42 and a duct portion 45 defined by the housing 32. Established by the tube 42, the slotted cover 43 and the duct portion 45 is a vapor passage with an inlet communicating via the opening 41 with the restricted chamber 40 and the cavity 22 and an outlet communicating with the surrounding environment via a discharge opening 46 in a top wall 47 of the housing 32. Retained by the housing 32 adjacent to the vapor passage duct portion 45 is electrical control circuitry 51 shown in FIGS. 1 and 4. Also retained by the housing 32 is an air blower 52 with an outlet disposed to discharge air into the duct portion 45 through an air passage exit opening 53 therein. Air is supplied to the blower 52 through air passage entrance openings 54 in a front wall portion 55 of the housing 32. A control switch 57 for actuating the electrical control circuit 51 is mounted on the front wall portion 55 of the housing 32. Also supported by the bottom plate 31 and extending transversely therefrom is a magnetically activated switch 61 shown in FIG. 3.

The liquid supply tank 13 includes a bottom wall portion 62 retained within the tank enclosure 21 of the base 14 and an upper portion 53 for storing a supply of liquid such as water. Closing an opening in the bottom wall portion 62 of the tank 13 is a threaded cap 64 (FIG. 3) that can be removed to fill the tank 13. A valve assembly 66 is retained by the bottom wall portion 62 of the tank 13. Forming the valve assembly 66 is a valve stem 67 extending through a discharge opening 68 in the bottom wall portion 62 and a valve 69. A spring 71 extending between the bottom wall portion 62 and a bracket 72 mounted on an end of the stem 67 normally biases the valve 69 into a seated position closing the discharge opening 68 as shown by dashed lines in FIG. 3. Projecting downwardly from the bottom wall portion 62 and enclosing a lower portion of the valve assembly 66 is a skirt 80 having an open bottom end 81 intersected by slots 82. A permanent magnet 73 extends downwardly from the bottom wall portion 62 of the tank 13 and is arranged for juxtaposition to the magnetic switch 61 with the tank 13 mounted on the base 14.

Figure 4:
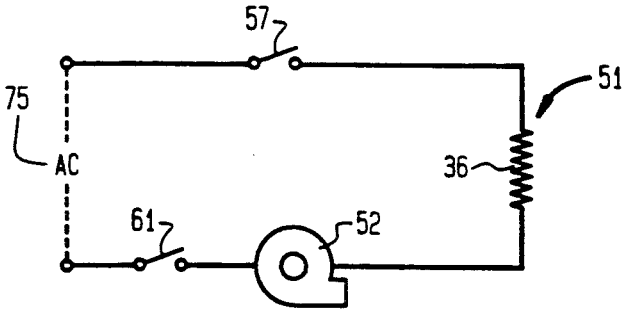
FIG. 4 is a circuit diagram of a control circuit of the humidifier shown in FIGS. 1-3.

As shown in FIG. 4, the control circuit 51 includes an AC supply 75 such as a conventional household outlet. Connected in series with the supply 75 by the manual switch 57 and the magnetic switch 61 and the heater coil 36 and the blower 52. The magnetic switch 61 is adapted in an active closed state to allow current flow to the heater coil 36 and the blower 61 and in an inactive open state to prevent current flow thereto.

OPERATION

To prepare the humidifier 11 for use, the tank 13 s removed from the base 14 and filled with water through an opening created by removal of the cap 64. With the cap 64 replaced and the normally seated valve 69 seated over the opening 68, the sealed tank 13 is inverted and positioned on the base 14 within the tank enclosure 21. Engagement of the bracket 72 on the valve stem 67 with the actuator stem 26 on the base 14 moves the valve 69 into an open position as shown by solid lines in FIG. 4. Accordingly, water from the tank 13 flows through the opened valve 69, the inlet end 25 and the liquid supply channel 23 into the boiler cavity 22. As long as a supply of water exists in the sealed tank 13, a water level L determined by the height of the slots 82 in the skirt 80 will be retained by the open valve 69 within the reservoir 20 formed by the boiler cavity 22 and the liquid supply channel 23.

Upon energization of the heater coil 36, water within the restricted chamber 40 that has flowed through the orifice 38 into the enclosure 37 is heated to cause evaporation and dispersal thereof. Because of the restricted and isolated water volume provided by the enclosure 37 in the boiler cavity 22, an extremely efficient evaporation process is obtained. The vapor produced in the enclosure 37 rises through the tube 42, the slotted cover 43 and the duct portion 45 of the housing 32 for discharge through the discharge end 46 into the surrounding environment. Enhancement of the vapor discharge is obtained by energizing the blower 52 which draws air through the entrance passages 54 in the housing 32 for discharge through the exit passage 53. This air draws vapor formed in the boiler cavity 22 through the duct portion for discharge from the discharge end 46.

If the supply tank 13 is in place on the base 14 to establish the active closed state of the magnetic switch 61, energization of the heater coil by current flow from the supply 75 is initiated by manual closing of the switch 57. However, if the supply tank 13 is removed from the base 14, separation of the magnet 73 from the tank sensing switch produces the inactive open state thereof to inactivate the supply 75 and prevent current flow to the coil 36 and the blower 52. Undesirable energization of the heater coil 36 and blower 52 are prevented, therefore, by removal of the tank 13 from the base 14.

Obviously, many modifications and variations of the present invention are possible in light of the above teachings. It is to be understood, therefore, that the invention can be practiced otherwise than as specifically described.

What is claimed is:

1. A humidifier comprising:

base means defining a cavity;

liquid tank means removably mounted on said base means and adapted to maintain a given level of liquid in said cavity;

electrically energized humidification means adapted to induce dispersal of the liquid contained in said cavity; and tank sensing means for sensing the absence or presence of said tank means on said base means.

2. A humidifier according to claim 1 including electrical supply means for supplying electrical current to said humidification means, and wherein said tank sensing means deactivates said humidification means in response to removal of said tank means from said base means.

3. A humidifier according to claim 2 including electrical control circuit means operable to prevent current to said humidification means in response to said removal of said tank means.

4. A humidifier according to claim 3 wherein said tank sensing means is an electrical switch means adapted to allow current flow to said humidification means in an active state and to prevent current flow to said humidification means in an inactive state.

5. A humidifier according to claim 4 wherein said electrical switch means comprises a magnetically operated switch mounted on said humidification means and operatively coupled to said supply means, and a magnet means mounted on said tank means and arranged to activate said switch into said active state with said tank means mounted on said base means and to deactivate said switch into said inactive state with said tank means removed from said base means.

6. A humidifier comprising:

a base means defining a boiler cavity;

a liquid supply means supported on said base means and having a discharge opening communicating with said boiler cavity and adapted to maintain a given level of liquid therein;

an evaporation unit mounted on said base means and comprising an electrically energized heater means projecting into said cavity and adapted to induce evaporation of liquid contained thereby, and a vapor passage defining means having a receiving end communicating with said cavity so as to receive vapor therefrom and a discharge end for discharging the vapor received from said cavity;

electrical supply means for supplying electrical energy to said heater means; and a protective enclosure means enclosing said evaporator means, said enclosure having a bottom wall restricting physical access to said heater means while permitting within said cavity substantially unimpeded vertical movement of solid particles.

7. A humidifier according to claim 6 wherein said evaporation unit is removably mounted on said base means.

8. A humidifier according to claim 7 wherein said protective enclosure means is secured to said evaporation unit.

9. A humidifier according to claim 8 wherein said bottom wall is a latticed wall.

10. A humidifier according to claim 9 including a liquid supply means supported on said base means and having a discharge opening communicating with said boiler cavity and adapted to maintain a given level of liquid therein.

* * * * *